United States Patent [19]

Runyan et al.

[11] Patent Number: 4,912,441

[45] Date of Patent: Mar. 27, 1990

[54] DRIVE MECHANISM FOR CIRCUIT BREAKER

[75] Inventors: Daniel Runyan, Hickmans; Thomas A. Edds, Lincoln, both of Nebr.

[73] Assignee: Square D Company, Palatine, Ill.

[21] Appl. No.: 211,620

[22] Filed: Jun. 27, 1988

[51] Int. Cl.[4] ..... H01H 3/00

[52] U.S. Cl. ..... 335/185; 335/23; 335/190

[58] Field of Search ..... 335/23, 35, 90, 185, 335/186, 187, 188, 189, , 190, 191, 192, 194

[56] References Cited

U.S. PATENT DOCUMENTS 2,904,655 9/1959 Gelzheiser et al. ..... 335/35

3,436,710 4/1969 Stokes ..... 335/90

*Primary Examiner*—Leo P. Picard

*Assistant Examiner*—Lincoln Donovan

*Attorney, Agent, or Firm*—Jose W. Jimenez; Thomas B. Lindgren

[57] ABSTRACT

A circuit breaker consisting of a housing having a fixed contact and a movable contact mounted on a blade which in turn is pivotally supported on a blade carrier that is pivoted within the housing and a handle that cooperates with the blade carrier to pivot the carrier between positions. A trip lever is pivotally mounted in the housing and has biasing means interposed between the blade and the trip lever to pivot the blade between respective positions with latch means holding the trip lever in a position where the blade and blade carrier are biased to close the contacts. The handle and carrier have cooperating camming surfaces that magnify the forces applied to the handle for pivotal movement of the carrier.

6 Claims, 3 Drawing Sheets

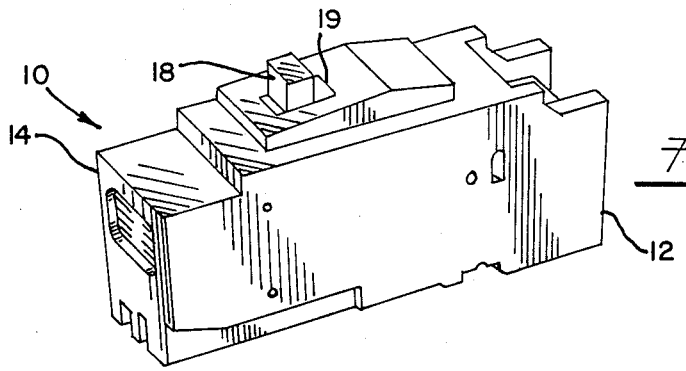
FIG. 1
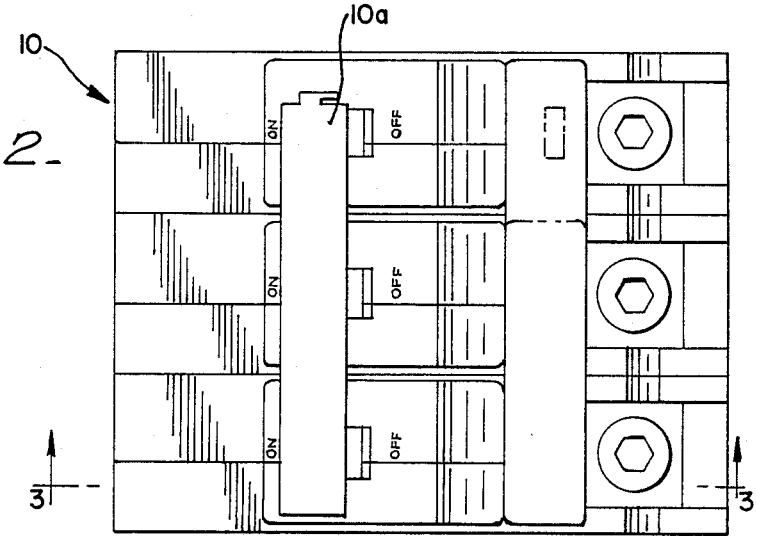
FIG. 2
FIG. 3
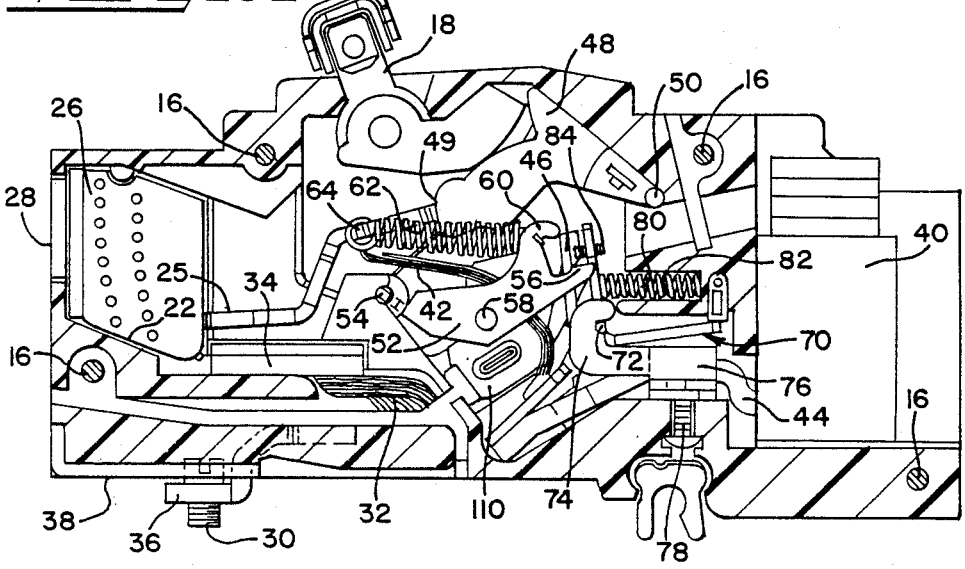

DRIVE MECHANISM FOR CIRCUIT BREAKER

DESCRIPTION

1. Technical Field

The present invention relates to molded case circuit breakers in general, and more particularly relates to construction of the rest mechanism for such circuit breakers.

2. Background Prior Art

Molded case circuit breakers have received a remarkable degree of commercial success in recent years. Most small commercial circuit breakers of this type use a simple mechanism where the movable contact supporting element or blade, which moves to break current, is hinged to pivot in the handle. The circuit breakers of this type generally incorporate some type of spring mechanism between the blade and the housing to provide the necessary contact force between the movable and fixed contacts. The force of the spring mechanism is thus directly related to the force required to turn the breaker "on" and "off" or relatch the circuit breaker.

As is well known, a higher contact force is required for higher current carrying capability, which in turn requires higher forces to relatch the circuit breaker and turn it "on" and "off". To overcome this higher force requirement for resetting and turning the circuit breaker "on" and "off", generally the prior art circuit breakers incorporate a toggle mechanism, including first and second links interposed between the blade and the handle. While such an arrangement reduces the forces required for resetting the circuit breaker, it also increases the current required to open the contacts.

SUMMARY OF THE INVENTION

According to the present invention, a reset mechanism for a circuit breaker has been developed which eliminates the toggle linkage and incorporates a minimum number of parts that requires less input for resetting the movable contact.

More specifically, the circuit breaker includes a housing having a fixed contact and a movable contact mounted on a blade that is pivoted on a blade carrier which in turn is pivoted in the housing. A trip lever is pivoted in the housing and has cooperating latch means. Biasing means are interposed between the trip lever and the blade, which bias the blade and the lever to a tripped position and bias the movable contact to a closed position.

According to the primary aspect of the invention, a pivoted reset handle cooperates with the carrier through camming surfaces which reduce the forces required for resetting the circuit breaker after it has tripped. More specifically, the camming surfaces are in the form of involute gears that magnify the forces applied by the handle to the carrier so that less input force is required for overcoming the spring forces that perform the tripping function.

BRIEF DESCRIPTION OF DRAWINGS

FIG. 1 is a perspective view of the molded case circuit breaker incorporating the features of the present invention;

FIG. 2 is a top plan view of the circuit breaker assembly consisting of three circuit breakers of the type shown in FIG. 1;

FIG. 3 is a cross-sectional view of the circuit breaker showing the internal operating parts in an "on" position;

DETAILED DESCRIPTION

Figure 4:
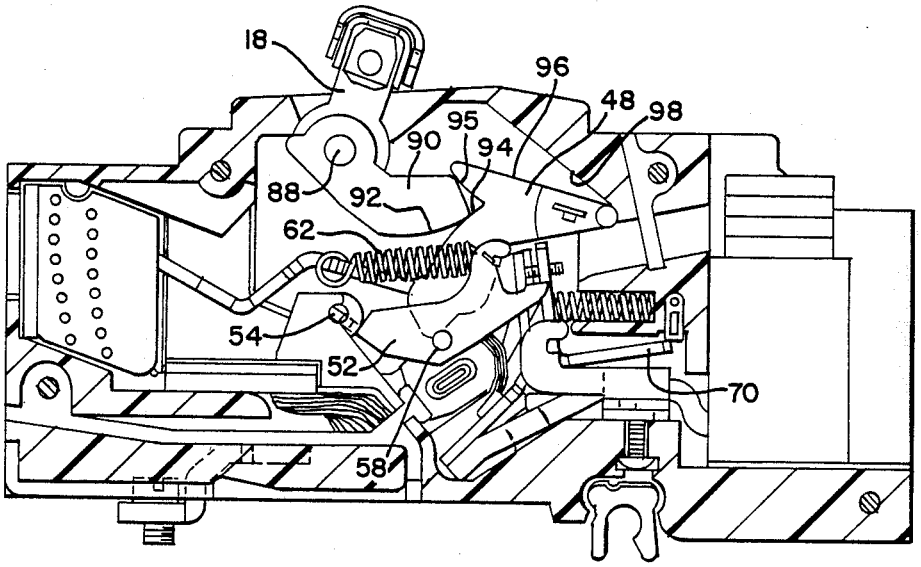
FIG. 4 is a view similar to FIG. 3 showing the circuit breaker in the "off" position.
Figure 5:
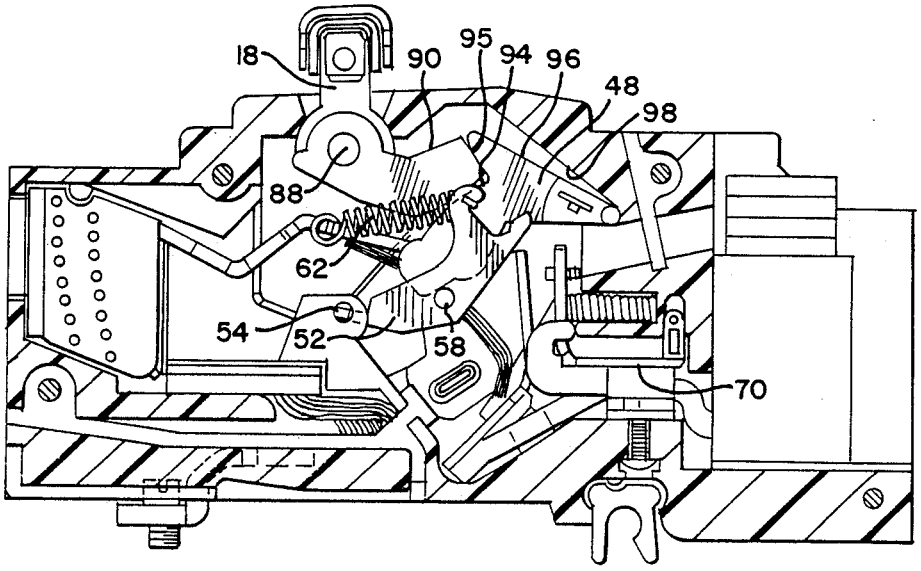
FIG. 5 is a view similar to FIG. 3 showing the parts in an intermediate tripped position.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

FIG. 1 of the drawings discloses a circuit breaker, generally designated by reference numeral 10. The circuit breaker 10 includes a plastic housing that consists of a base 12 and a cover 14 which are interconnected through a plurality of screws 16 (see FIG. 3). The circuit breaker 10 includes a pivoted handle 18 that extends through an opening 19 in the molded plastic casing.

The circuit breaker housing incorporates a fixed contact 22 and a movable contact 24 which is mounted on a contact arm or blade 25. The fixed contact is positioned within an arcstack assembly 26, which is externally vented through a baffle 28.

The fixed contact 22 is connected to a bolt assembly 30 through a flexible conductor 32 and fixed connector assembly 34. The screw 30 is threaded into an opening in a slide plate 36 and the head of the screw 30 is located within a longitudinal slot 38 located in the bottom of the base 12.

The movable arm or blade 25 is connected to a lug 40 through a flexible conductor 42 and a fixed conductor 44 which has a bi-metallic member 46 welded thereto, for a purpose that will be described later. The end of the contact arm 25 has a reduced end portion or tab which is received into a slot (not shown) of a pivoted blade carrier 48 that is pivoted about a fixed axis 50 at its opposite end. Thus, the tab and slot define the pivot axis 49 for the blade 25 on the carrier 48. The details of the blade carrier 48 will be described hereinafter.

A trip lever 52 has lateral projections 54 at one end which are pivotally supported in the housing. The trip lever consists of two arms that are transversely-spaced and each arm has a shoulder 56 defined on the free end thereof. The two arms are interconnected intermediate opposite ends by a cross pin or camming pin 58. The free end of each arm also has an ear 60 defining a spring connection for a spring 62, the opposite end of which is connected to the blade 25 through a tab 64.

A latch mechanism 70 cooperates with the shoulders 56 for retaining the trip lever 52 in the position shown in FIG. 3 where the circuit breaker is in the closed position. The latch means 70 consists of a generally L-shaped arm that has pivot pins 72 located at the juncture between the arms, and the pivot pins are pivotally supported in ears 74 which are part of a yoke assembly 76 that is fixed within the housing through a set screw 78. The latch mechanism 70 is pivoted to the latched position shown in FIG. 3 by a compression coil spring 80 that is received into an opening 82 in the housing. An adjustable set screw 84 is threaded into one arm and is biased into engagement with bi-metallic member 46 that extends upwardly from conductor plate 44.

According to one aspect of the invention, the reset handle 18 and the blade carrier 48 have cooperating camming means for moving the carrier 48 between positions. Thus, the handle 18 is pivoted about a fixed pivot 88 within the housing and has an arm 90 extending therefrom. The arm 90 has a lower camming surface 92 that cooperates with a camming surface 94 on the blade carrier. The blade carrier 48 has a shoulder 95 defined thereon and the end of the arm 90 cooperates with the shoulder to pivot the carrier from the "off" position shown in FIG. 4 to the "on" position shown in FIG. 3. The carrier 48 also has an abutment 96 that cooperates with an abutment 98, as will be explained later.

Figure 6:
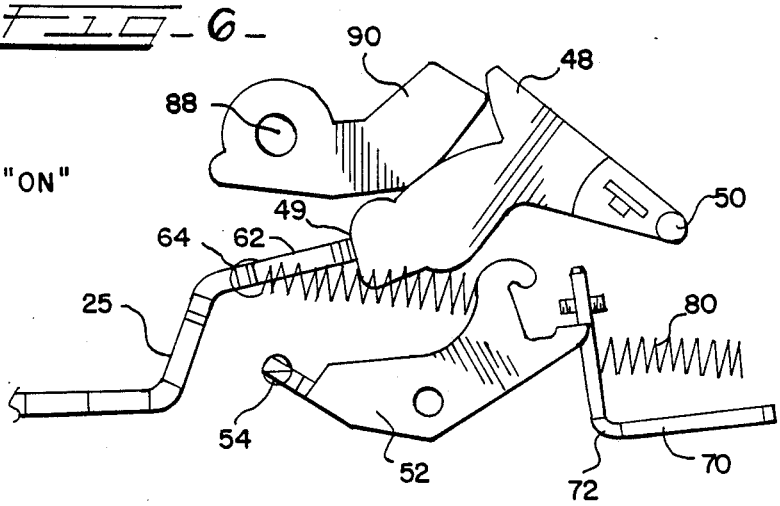
FIG. 6 shows the movable elements in the "on" position.

Considering now the operation of the circuit breaker which is shown in the "on" position in FIGS. 3 and 6. In the "on" or closed position, the lever carrier has its abutment surface 96 engaging the housing abutment 98, as shown in FIG. 3, and the pivoted lever 18, in conjunction with the biasing means 62, biases the carrier upwardly into engagement with the handle arm. The blade or contact arm 25 is also in the closed position by the bias of spring means or tension springs 62, while the trip lever 52 is held in the latched position by the latch means 70. It should be noted that in this position, the axis of the of the tension springs 62 is located below the pivot point 49 between the blade 25 and the carrier 48 so that the biasing force tends to pivot the blade 25 downward or into engaging contact with the fixed contact.

Figure 8:
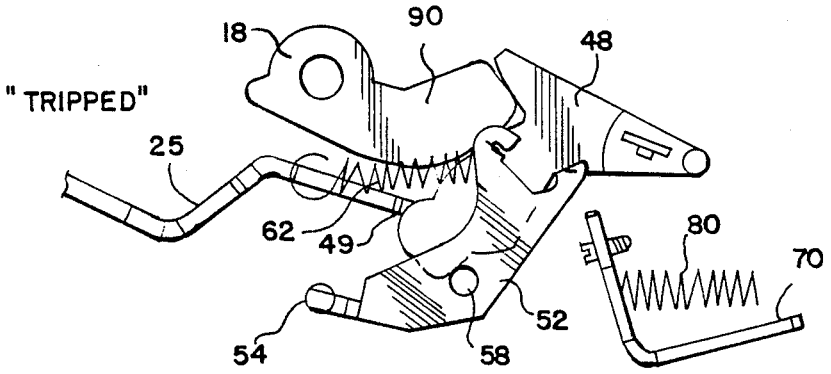
FIG. 8 shows the movable elements in the intermediate tripped position.

Assuming that an overcurrent condition is developed in the circuit breaker, such overcurrent condition will activate an electromagnet (not shown) to pivot the latch means 70 in a clockwise direction, as viewed in the drawings, which will release the trip lever 52. The trip lever will pivot about pivot axis 54 because of the tension in the springs 62 and this pivotal movement will move the axis of the springs 62 above the pivot axis 49 between the lever 25 and the carrier 48. Thus, the spring forces of springs 62 will produce a pivotal motion between the blade 25 and the carrier 48 to move the blade to an open position, as shown in FIG. 8. In this intermediate tripped position, the camming pin 58 is in engagement with the lower edge of the carrier 48 and the handle 18, along with arm 90, is moved to an intermediate tripped position. In this intermediate tripped position, the latch means 70 is moved to the reset position by the spring 80 (FIG. 8). The trip lever can also be released thermally. Thus, when an overcurrent condition occurs, the bi-metallic member 46 will tend to expand and pivot clockwise and pivot the latch mechanism to release the trip lever 52.

After the circuit breaker has been tripped, the actuating mechanism must be moved to the "off" position before the circuit breaker can be reset. To move the mechanism to the "off" position, the handle 18 is pivoted in the clockwise direction from the position shown in FIG. 8 to the position shown in FIG. 7. During this movement, the interaction between the camming surfaces 92 and 94 will pivot the carrier 48 in the counterclockwise direction which in turn will pivot the trip lever 52 in the clockwise direction about pivot axis 54 to the reset position shown in FIG. 7. During this movement, the end surface of the trip lever 52 will cam across the surface of the upper end of the latch mechanism 70 and will re-engage tee shoulder 56 with the latch mechanism 70. During the pivotal movement of the trip lever, the pivot axis for the springs 62 is about the tabs 64 on blade 25 so that the blade 25 will remain in an open position.

Figure 7:
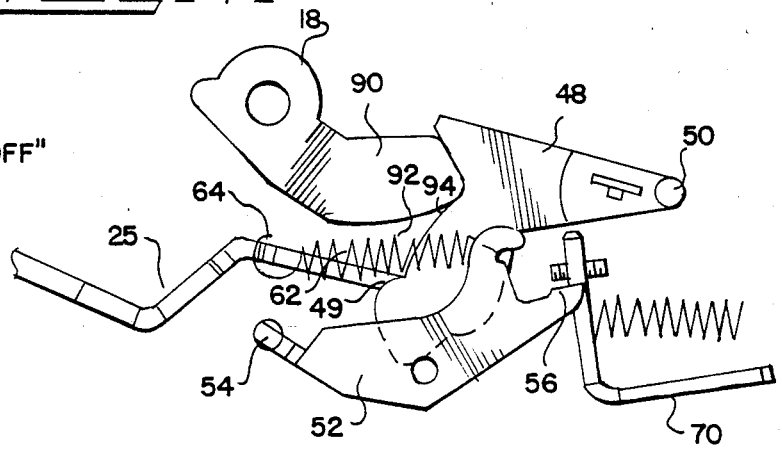
FIG. 7 shows the movable elements in the "off" position.

After the mechanism has been moved to the "off" position, as shown in FIG. 7, the circuit breaker can be reset to an "on" position by counterclockwise pivotal movement of the handle 18. During this counterclockwise pivotal movement of the handle 18, the carrier will be pivoted in a clockwise direction about pivot axis 50, which in turn will cause the axis of the springs 62 to cross the pivotal connection 49 and thereafter apply a counterclockwise pivotal movement to the blade 25 to return the blade to the closed position for the contacts 22 and 24.

The circuit breaker described above is preferably positioned such that multiple circuit breakers are actuated in response to the tripping of one of the circuit breakers. For this purpose, as shown in FIG. 2, three identical circuit breakers 10 have the handle 18 connected by a U-shaped connecting member 100 so that all three circuit breakers will be in the same position. Also, a trip cam 110 (FIG. 3) extends between the respective circuit breakers 10 and cooperates with the camming pin 58 so that all circuit breakers are tripped in response to one breaker having an overcurrent condition.

It should be noted that the configuration of the various components could easily be changed without departing from the spirit of the invention. For example, the camming surfaces 92 and 94 have been described as being an involute gear configuration, but other configurations, such as hypoid or helical gears could be substituted with similar results.

It should also be noted that the arrangement of the components simplifies the assembly operation. All of the components are loosely assembled with the camming pin 58 removed so that the springs 62 are relaxed. The trip lever can then be reset or latched onto latch mechanism 70, which requires that minimum spring forces must be overcome. The camming pin can then be inserted and the handle can then be used to open and close the contacts.

While the specific embodiments have been illustrated and described, numerous modifications come to mind without significantly departing from the spirit of the invention and the scope of protection is only limited by the scope of the accompanying Claims.

We claim:

1. A circuit breaker including a housing having a fixed contact and a movable contact mounted on a blade, a blade carrier pivotally supported in said housing about a first axis with said blade having one end pivoted thereon, a trip lever pivotally mounted in said housing about a second axis with biasing means interposed between said blade and said trip lever, handle means extending from said housing and pivotally supported in said housing about a third axis, said handle means cooperating with said blade carrier for opening and closing said contacts and latch means cooperating with said trip lever for maintaining said blade and blade carrier in a position where said contacts are closed, said first, second and third axes being offset from each other.

2. A circuit breaker as defined in claim 1, in which said handle means and said blade carrier having cooperating camming surfaces to drive said blade carrier in response to movement of said handle means.

3. A circuit breaker as defined in claim 2, in which said camming surfaces are defined by involute gear surfaces.

4. A circuit breaker as defined in claim 1, in which said trip lever is pivoted at one end in said housing with said biasing means connected to an opposite end thereof and said biasing means is connected to said blade intermediate opposite ends thereof.

5. A circuit breaker including a housing having a stationary contact and a movable contact supported on an arm pivoted about a pivot axis with first biasing means biasing said arm to a position where said contacts are separated, a trip lever pivoted in said housing with pivoted latch means cooperating with one end of said lever for maintaining said lever in a reset position and second biasing means biasing said latch means to a reset position, a manually-operated reset handle pivotally supported in said housing and having a camming surface thereon, an actuating member pivotally supported in said housing and having a cooperating camming surface thereon with said arm, pivoted thereon, said actuating member cooperating with said lever and said arm to move to an intermediate position upon release of said arm so that said reset handle must be pivoted to an "off" position before being resettable to an "on" position.

6. A circuit breaker including a housing having a fixed contact and a movable contact mounted on a movable contact arm, an actuating member pivotally mounted in said housing with said contact arm having one end supported on said actuating member, a reset handle pivoted in said housing and having a camming surface cooperating with said actuating member, a trip lever pivoted at oneend in said housing with biasing means interposed between said trip lever and said arm, and latch means cooperating with said trip lever for maintaining said contact arm in a reset position with said contacts closed.

* * * * *